US006155872A

United States Patent [19]

Wu

[11] Patent Number: 6,155,872

[45] Date of Patent: Dec. 5, 2000

[54] STACKED CONNECTOR ASSEMBLY HAVING MIXED-TYPE CONNECTORS AND IMPROVED SHIELDING EFFECTIVENESS

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/330,518

[22] Filed: Jun. 11, 1999

[30] Foreign Application Priority Data

Nov. 24, 1998 [TW] Taiwan ..... 87219527

[51] Int. Cl.[7] ..... H01R 13/66; H01R 13/648

[52] U.S. Cl. ..... 439/541.5; 439/607

[58] Field of Search ..... 439/541.5, 607, 439/101, 608, 609, 610, 79, 80, 676; 174/35

[56] References Cited

U.S. PATENT DOCUMENTS 5,295,870 3/1994 Rei et al. ..... 439/717

5,766,043 6/1998 Talend ..... 439/676

5,980,320 11/1999 Slack et al. ..... 439/607

*Primary Examiner*—Brian Sircus

*Assistant Examiner*—Chandrika Prasad

*Attorney, Agent, or Firm*—Wei Te Chung

[57] ABSTRACT

A stacked connector assembly includes an RJ connector and two stacked USB connectors stacked on the RJ connector. The RJ connector has a first housing. The USB connectors have a common second housing. A tenon-mortise joint is formed between the first and second housings to secure the housings together. An outer shield encloses both the RJ connector and the USB connectors. Each USB connector has an inner shielding member received in a receiving chamber thereof. The outer shield has two side walls extending through slots defined in the USB connectors in communication with the receiving chambers thereof for engaging with the inner shielding members.

20 Claims, 5 Drawing Sheets

STACKED CONNECTOR ASSEMBLY HAVING MIXED-TYPE CONNECTORS AND IMPROVED SHIELDING EFFECTIVENESS

BACKGROUND OF THE INVENTION

1. Field of the Invention

The present invention generally relates to a stacked connector assembly, and in particular to a modularized connector assembly comprising different connector units.

2. The Prior Art

Conventional connectors are usually mounted to a circuit board individually. Such an assembly process is inefficient and the connectors occupy a significant amount of space on the circuit board. A stacked connector assembly overcomes such disadvantages by vertically stacking two identical connectors together. However, with the rapid development of the electronic and telecommunication industries, a stacked connector assembly with only two identical connectors may not be sufficient for addressing the needs of an electronic device. Furthermore, cross-talk between contacts of the connectors and exposure to external electromagnetic interference are serious problems facing miniaturized electrical connectors. A stacked connector assembly requires effective shielding to overcome the problems.

SUMMARY OF THE INVENTION

Accordingly, an object of the present invention is to provide a stacked connector assembly integrating different connector units together.

Another object of the present invention is to provide a stacked connector assembly having a number of different connector units vertically stacked on each other thereby reducing the space occupied thereby on a circuit board.

A further object of the present invention is to provide a stacked connector assembly having effective shielding capabilities.

To achieve the above objects, a stacked connector assembly in accordance with the present invention comprises an RJ connector and two stacked USB connectors stacked on the RJ connector. The RJ connector has a first housing. The USB connectors have a common second housing. A tenon-mortise joint is formed between the first and second housings to secure the housings together. An outer shield encloses both the RJ connector and the USB connectors. Each USB connector has an inner shielding member received in a receiving chamber thereof. The outer shield has two side walls extending through slots defined in the USB connectors in communication with the receiving chambers thereof for engaging with the inner shielding members.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 3:
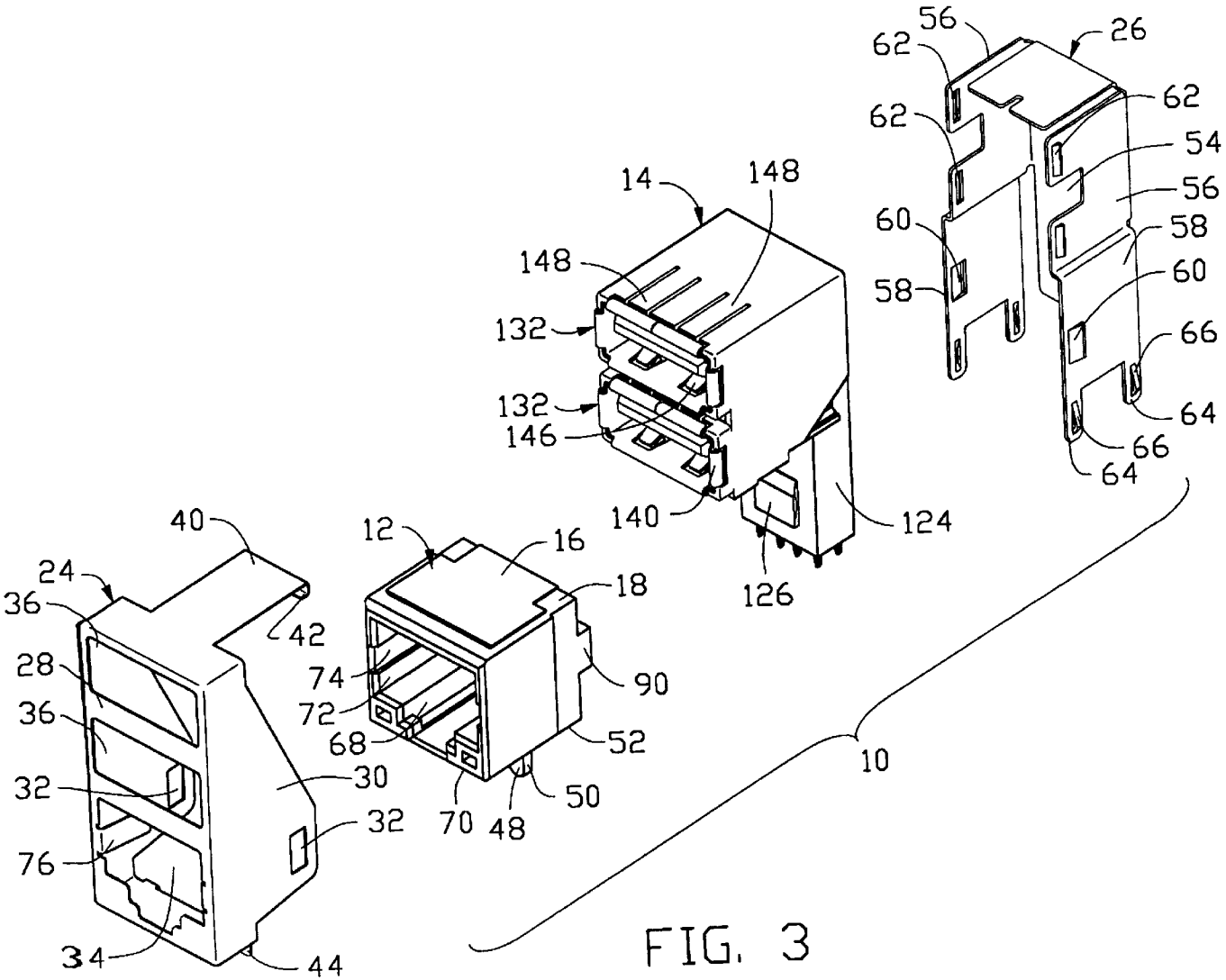
FIG. 3 is a partially assembled view of FIG. 1.
Figure 4:
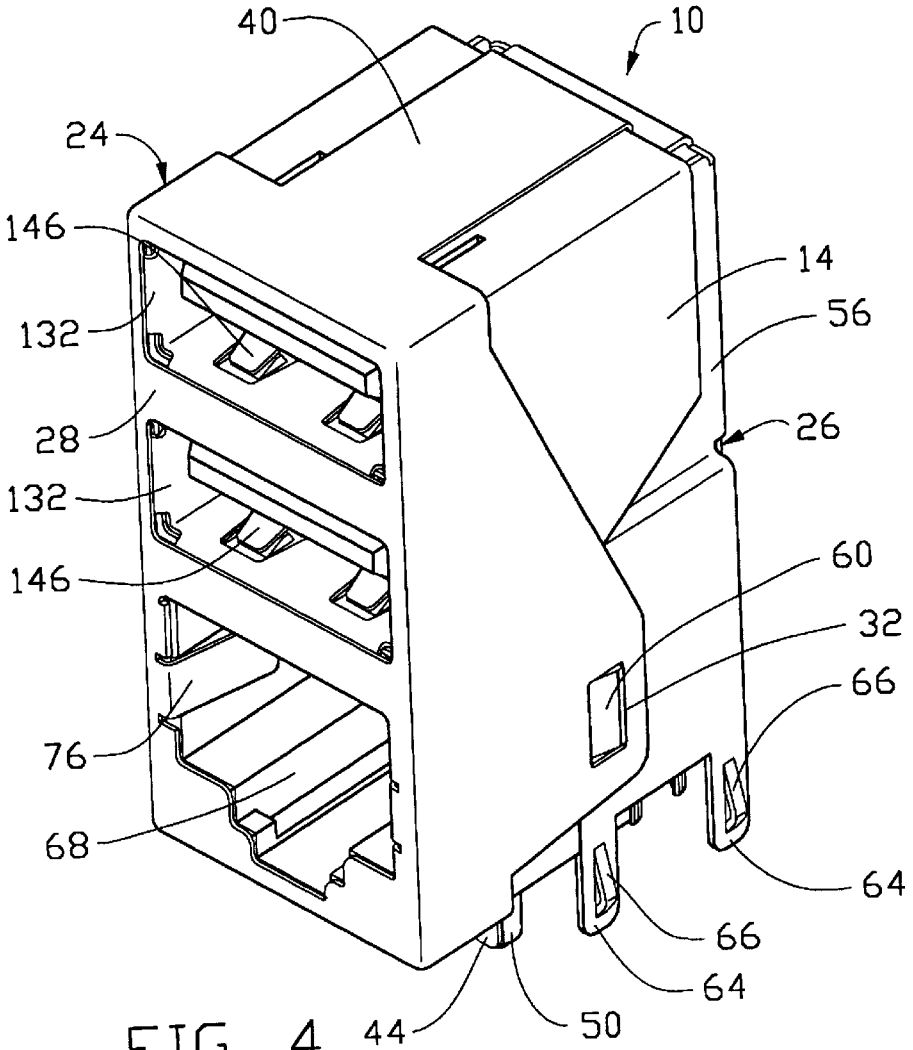
FIG. 4 is an assembled view of FIG. 1.

Referring to the drawings and in particular to FIGS. 3 and 4, a stacked connector assembly 10 constructed in accordance with the present invention comprises an outer shield (not labeled) enclosing a first insulative housing 12 forming a first connection unit and a second insulative housing 14 forming a second connection unit stacked on the first housing 12. The first and second connection units may be different. In the embodiment illustrated, the first connection unit is an RJ45 connector and the second connection unit comprises two stacked USB (Universal Serial Bus) connectors.

A dovetailed joint is formed between the first and second housings 12, 14 which comprises a dovetailed tenon 16 formed on a top face 18 of the first housing 12 and a dovetailed mortise (not labeled) formed by a number of blocks 20 (FIG. 2) extending from a bottom face 22 of the second housing 14.

The two USB connectors may be integrated together as a single unit having a single housing 14. Alternatively, the two USB connectors may be separate, each having a housing constituting a portion of the housing 14.

The outer shield comprises a front shielding member 24 and a rear shielding member 26. The front member 24 has a front wall 28 and two side walls 30. Each side wall 30 of the front shielding member 24 defines an aperture 32 therein. A first opening 34 and two second openings 36 are defined in the front wall 28 respectively corresponding to the RJ45 connector of the first connection unit and the two USB connectors of the second connection unit. A top tab 40 perpendicularly extends from the front wall 28 and forms U-shaped fingers 42 on a free end thereof for engaging with the second housing 14 thereby securing the front shielding member 24 to the second housing 14. Bottom tabs 44 extend from the front wall 28 in a direction substantially parallel thereto. The bottom tabs 44 abut against planar faces 48 formed on positioning posts 50 extending from a bottom face 52 of the first housing 12. The bottom tabs 44 and the positioning posts 50 are inserted into corresponding holes defined in a circuit board (not shown) for properly positioning the stacked connector assembly 10 thereon.

The rear shielding member 26 has a rear wall 54 and two side walls 56 having free edges. Each side wall 56 has an offset extension 58 on which an outward projection 60 is formed for engaging with the corresponding aperture 32 of the front shielding member 24 thereby securing the rear shielding member 26 to the front shielding member 24. Each side wall 56 forms projections 62 thereon.

Retaining tabs 64 extend from each extension 58 of the rear shielding member 26 to be inserted into holes defined in the circuit board for grounding purposes. Each retaining tab 64 forms a resilient finger 66 for engaging with the corresponding hole of the circuit board thereby retaining the stacked connector assembly 10 on the circuit board.

The first housing 12 defines a first receiving chamber 68 exposed to a front face 70 thereof. The first receiving chamber 68 aligns with the first opening 34 of the front shielding member 24 for receiving a mating plug connector (not shown). The first receiving chamber 68 has two opposite inside surfaces 72 each defining a groove 74 for snugly receiving an inward extension 76 of the front shielding member 24 for properly positioning and further securing the front shielding member 24 to the first housing 12.

Figure 1:
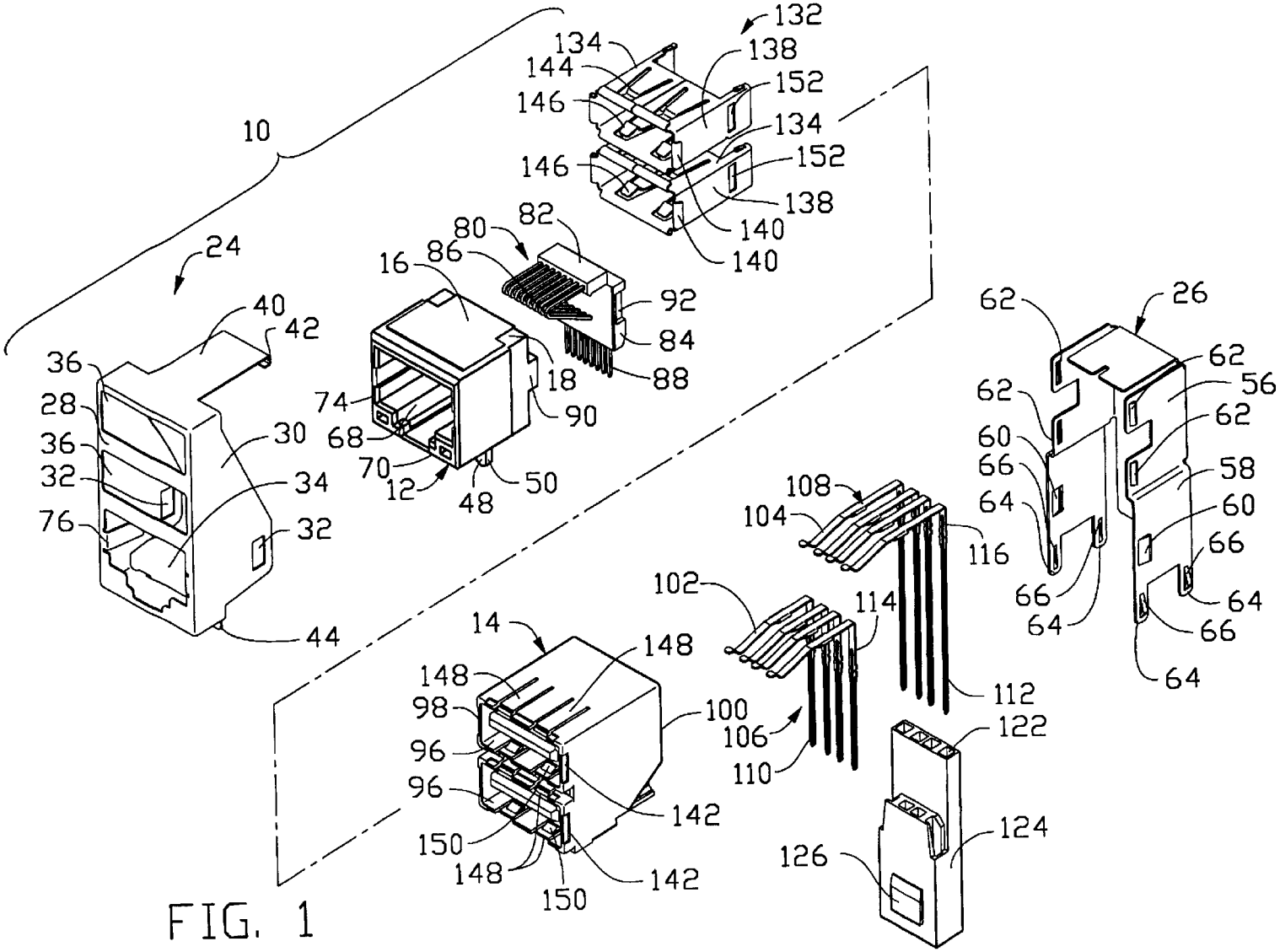
FIG. 1 is an exploded view of a stacked connector assembly in accordance with the present invention.
Figure 2:
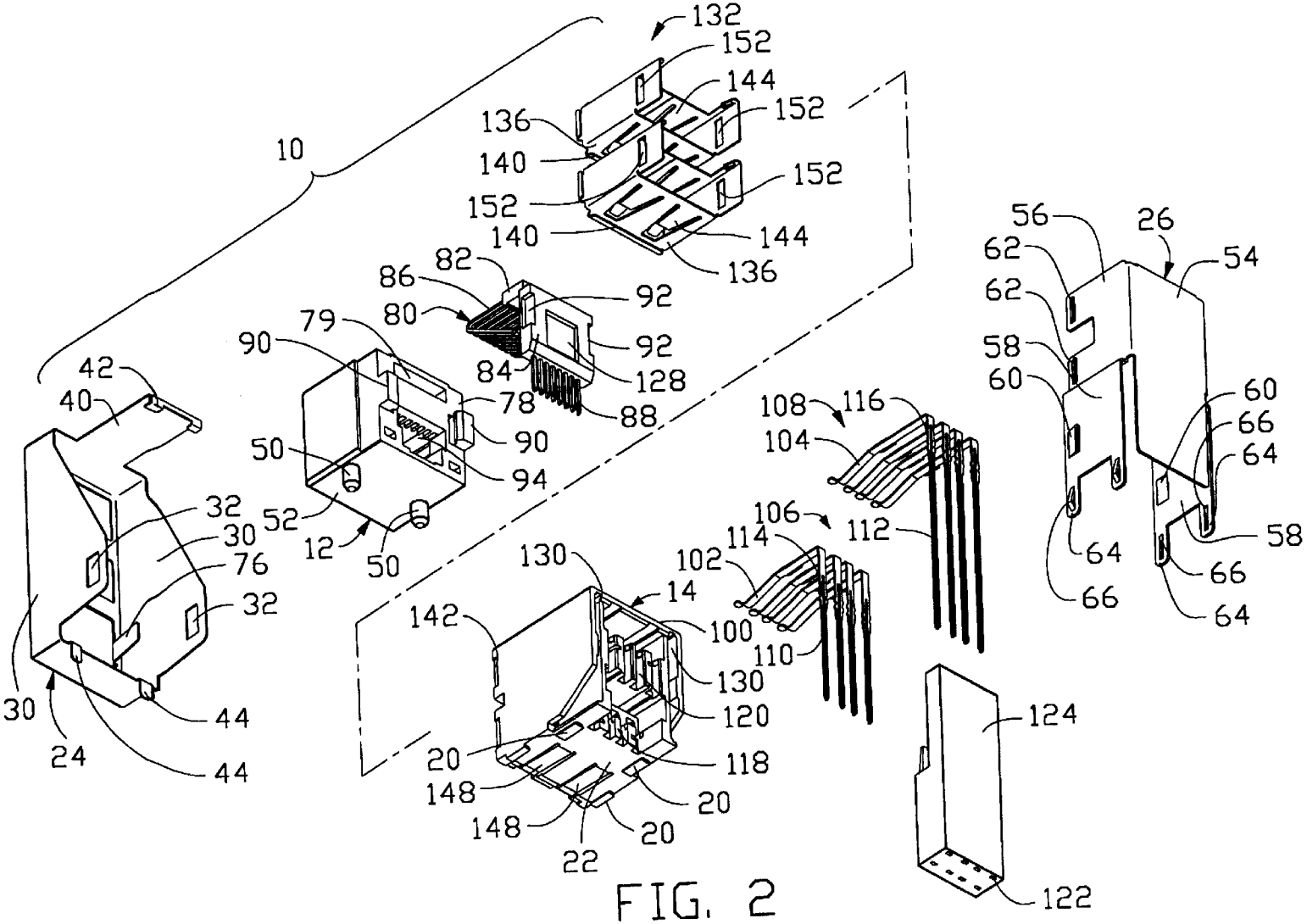
FIG. 2 is similar to FIG. 1 but taken from a different perspective.

Referring to FIGS. 1 and 2, the first housing 12 has a rear face 78 defining a channel 79 therein in communication with the receiving chamber 68 for receiving first contact elements 80 therein. The first contact elements 80 are retained together by means of a first spacer block 82 and a second spacer block 84. Each first contact element 80 comprises a horizontal section 86 and a vertical section 88 substantially perpendicular to each other with the first spacer block 82 retaining the horizontal sections 86 and the second spacer block 84 retaining the vertical sections 88. The first spacer block 82 is received in the channel 79 of the first housing 12 for positioning the horizontal sections 86 of the first contact elements 80 within the first receiving chamber 68. The rear face 78 of the first housing 12 has a pair of resilient barbs 90 engaging with edge recesses 92 defined in the second spacer block 84 thereby securing the second spacer block 84 to the rear face 78 of the first housing 12. The first housing 12 also defines a number of grooves 94 in communication with the first receiving chamber 68 for receiving and thus properly positioning the horizontal sections 86 of the first contact elements 80 during insertion of the mating plug connector into the first receiving chamber 68 of the first housing 12.

As noted above, the second connection unit comprises two stacked USB connectors. Accordingly, the second housing 14 defines two second receiving chambers 96 exposed to a front face 98 of the second housing 22 and aligning with the second openings 36 of the front shielding member 24 for each receiving a mating USB plug connector (not shown).

The second receiving chambers 96 are also exposed to a rear face 100 of the second housing 14 for receiving horizontal sections 102, 104 of second contact elements 106, 108 therein. The U-shaped fingers 42 of the top tab 40 of the front shielding member 24 engage with an edge of one of the second receiving chambers 96 on the rear face 100 of the second housing 14. The second contact elements 106, 108 also have vertical sections 110, 112 substantially perpendicular to the horizontal sections 102, 104. Each vertical section 110, 112 has a portion 114, 116 received in a corresponding slot 118, 120 defined in the rear face 100 of the second housing 14 for properly positioning the second contact elements 106, 108 with respect to the housing 14. The vertical sections 110, 112 of the second contact elements 106, 108 are received in passageways 122 defined in a spacer 124. The spacer 124 has a raised section 126 received in a recess 128 defined in the second spacer block 84.

The second housing 14 also defines a pair of slots 130 in the rear face 100 thereof for receiving the free edges of the side walls 56 of the rear shielding member 26. The slots 130 communicate with the second receiving chambers 96 whereby the projections 62 of the side walls 56 of the rear shielding member 26 extend into the second receiving chambers 96.

Each second receiving chamber 96 receives an inner shielding member 132 therein. Each inner shielding member 132 comprises a top wall 134, a bottom wall 136 and two side walls 138 having bent flanges 140 fit into recesses 142 defined in the second housing 14. The top wall 134 and the bottom wall 136 of each inner shielding member 132 each form two resilient arms 144 each having a barb 146 projecting into the corresponding second receiving chamber 96 of the second housing 14 for electrically engaging with a grounding member of the mating USB plug connector (not shown). Preferably, cantilevered arms 148 are formed in the second housing 14 corresponding to and supporting the resilient arms 144 of the inner shielding members 132. Each cantilevered arm 148 forms a projection 150 for supporting the barb 146 of the corresponding resilient arm 144 of the inner shielding member 132.

Each side wall 138 of the inner shielding member 132 defines an opening 152 engaged with the corresponding projection 62 of the rear shielding member 26 thereby securing the inner shielding member 132 to the rear shielding member 26 and forming electrical engagement therebetween for grounding purposes.

Figure 5:
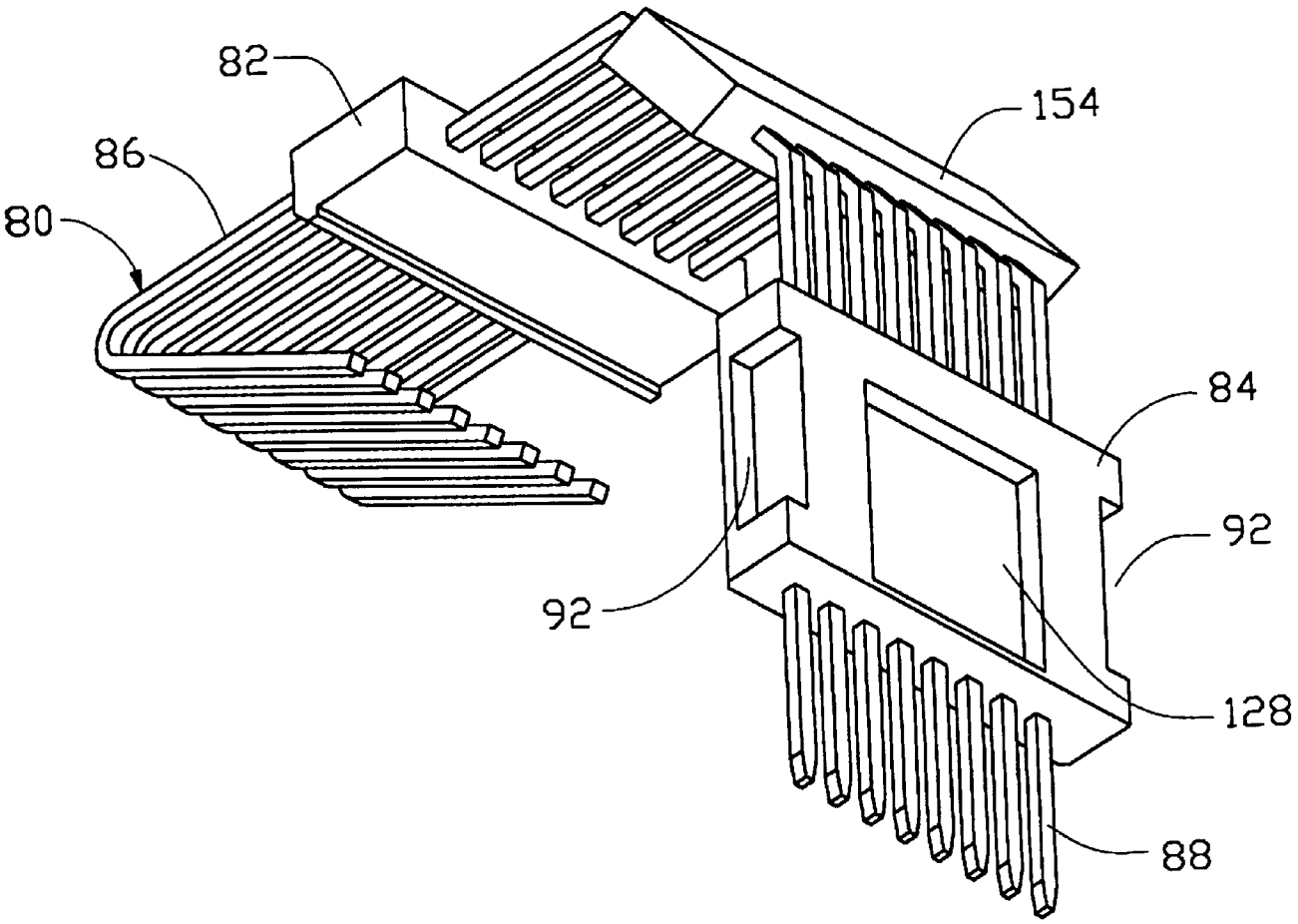
FIG. 5 is a perspective view of contact elements retained by spacer blocks in accordance with a second embodiment of the present invention.

FIG. 5 shows another embodiment of the present invention wherein cross-talk suppressing means 154 surrounds the first contact elements 80 between the first and second spacer blocks 82, 84 for eliminating cross-talk between the first contact elements 80.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A stacked connector assembly comprising:

a first insulative housing defining at least one first receiving chamber retaining first contact elements therein to construct a first type connector, the first type connector being adapted to receivingly mate with a first mating connector for establishing electrical engagement with the first contact elements;

a second insulative housing stacked on the first insulative housing, the second housing defining at least one second receiving chamber retaining second contact elements therein to construct a second type connector different from the first type connector, the second type connector being adapted to receivingly mate with a second mating connector for establishing electrical engagement with the second contact elements;

an outer shield substantially enclosing and electrically shielding the first and second housings; and an inner shielding member received in each of the second receiving chambers, enclosing the second contact elements in the second receiving chambers and electrically engaging the outer shield.

2. The stacked connector assembly as claimed in claim 1, wherein the outer shield comprises a front shielding member and a rear shielding member, the front shielding member having a front wall defining a first opening corresponding to each of the first receiving chambers and second openings corresponding to the second receiving chambers.

3. The stacked connector assembly as claimed in claim 1, wherein the outer shield comprises a front shielding member and a rear shielding member, the front shielding member comprising a front wall and two side walls, each side wall of the front shielding member defining at least one aperture, the rear shielding member comprising a rear wall and two side walls, each side wall of the rear shielding member forming a projection engaging with the aperture of the corresponding side wall of the front shielding member thereby securing the front and rear shielding members together.

4. The stacked connector assembly as claimed in claim 3, wherein the front shielding member comprises a top tab having a free end engaging with a rear face of the second housing.

5. The stacked connector assembly as claimed in claim 1, wherein the outer shield member comprises side walls having free edges, each side wall forming a projection, and wherein the second housing defines slots in communication with each second receiving chamber for receiving the side walls of the outer shield therein, the inner shielding member of the second receiving chamber defining openings therein for engaging with the projections of the side walls of the outer shield thereby securing and electrically connecting the inner shielding member to the outer shield.

6. The stacked connector assembly as claimed in claim 1, wherein the first housing defines a channel in a rear face thereof in communication with the first receiving chamber, the first contact elements being retained together by means of a first spacer block received in the channel thereby properly positioning a front section of each first contact element in the first receiving chamber.

7. The stacked connector assembly as claimed in claim 6, wherein the first contact elements have rear sections retained by a second spacer block fixed to the rear face of the first housing.

8. The stacked connector assembly as claimed in claim 7, wherein a pair of resilient barbs are formed on the rear face of the first housing for engaging with recesses defined in the second spacer block for fixing the second spacer block to the first housing.

9. The stacked connector assembly as claimed in claim 1, wherein the first housing has a top face and the second housing has a bottom face positioned on the top face of the first housing, the top face of the first housing forming a dovetailed tenon and the bottom face of the second housing defining a dovetail mortise engaging with the tenon thereby securing the first and second housings together.

10. The stacked connector assembly as claimed in claim 1, wherein the first housing has positioning posts extending therefrom adapted to be received in holes defined in a circuit board for properly positioning the stacked connector assembly on the circuit board.

11. The stacked connector assembly as claimed in claim 10, wherein each positioning post has a flat surface, and wherein the outer shield has a bottom tab abutting against the flat surface of each positioning post and received in the hole of the circuit board.

12. The stacked connector assembly as claimed in claim 1, wherein the second receiving chamber is exposed to a rear face of the second housing for receiving front sections of the second contact elements, the second contact elements having rear sections retained by a spacer.

13. The stacked connector assembly as claimed in claim 2, wherein inward extensions are formed on opposite edges of the first opening of the front shielding member for being snugly received in slots defined in inside faces of the first receiving chamber.

14. The stacked connector assembly as claimed in claim 1 further comprising cross-talk suppressing means mounted on the first contact elements.

15. The stacked connector assembly as claimed in claim 1, wherein the first housing has one first receiving chamber which together with the first contact elements forms an RJ type connector, and wherein the second housing has two second receiving chambers which together with the second contact elements form two USB type connector.

16. An electrical shielding device adapted to be mounted on an electrical connector to shield and protect contact elements arranged within a chamber defined in the connector, comprising an outer shield substantially enclosing the connector and an inner shielding member received in the chamber, the outer shield comprising side walls extending through slots defined in the connector and in communication with the chamber for electrically and mechanically engaging with the inner shielding member.

17. The electrical shielding device as claimed in claim 16, wherein the inner shielding member has side walls each defining an aperture, and wherein each of the side walls of the outer shield forms a barb engaging with the aperture of the corresponding side wall of the inner shielding member.

18. A stacked connector assembly comprising:

a first insulative housing defining at least one first receiving chamber retaining first contact elements therein and adapted to receivingly mate with a first mating connector for establishing electrical engagement with the first contact elements;

a second insulative housing stacked on the first insulative housing, the second housing defining at least one second receiving chamber retaining second contact elements therein and adapted to receivingly mate with a second mating connector for establishing electrical engagement with the second contact elements wherein said first mating connector is different from said second mating connector;

means provided on a top surface of the first housing and a bottom surface of the second housing for assembling the first housing and the second housing together; and an outer shield substantially enclosing and electrically shielding both the first and second housings.

19. The assembly as claimed in claim 18, wherein a first spacer is attached to the first housing, and a second spacer is attached to the second housing and positioned behind the first spacer.

20. The assembly as claimed in claim 19, further including means for engaging the first and the second spacers with each other.

* * * * *